United States Patent [19]

Sung et al.

[11] Patent Number: 4,490,154

[45] Date of Patent: Dec. 25, 1984

[54] FUELS CONTAINING AN ALKENYLSUCCINYL POLYGLYCOLCARBONATE ESTER AS A DEPOSIT-CONTROL ADDITIVE

[75] Inventors: Rodney L. Sung, Fishkill, N.Y.; Ernest L. Yeakey, Houston, Tex.; Walter D. Foucher, Jr., Glenham, N.Y.; Michael Cuscurida, Austin, Tex.

[73] Assignee: Texaco Inc., White Plains, N.Y.

[21] Appl. No.: 496,698

[22] Filed: May 20, 1983

[51] Int. Cl.[3] ..... C10L 1/18

[52] U.S. Cl. ..... 44/70; 44/58; 260/463

[58] Field of Search ..... 44/51, 58, 70; 252/407, 252/386; 260/463

[56] References Cited

U.S. PATENT DOCUMENTS

| | | | |
|---|---|---|---|
| 2,844,448 | 7/1958 | Heisler et al. | 44/58 |
| 4,267,120 | 5/1981 | Cuscurida et al. | 521/125 |
| 4,282,007 | 8/1981 | Sung | 44/56 |
| 4,302,215 | 11/1981 | Lewis | 260/463 |

*Primary Examiner*—William R. Dixon, Jr.
*Assistant Examiner*—Margaret B. Medley
*Attorney, Agent, or Firm*—Robert A. Kulason; James F. Young; James J. O'Loughlin

[57] ABSTRACT

A fuel for internal combustion engines containing as a deposit-control additive at least one alkenylsuccinyl (polycarbonate-polyglycolethyleneoxy)-B-hydroxy-propionate.

7 Claims, No Drawings

FUELS CONTAINING AN ALKENYLSUCCINYL POLYGLYCOLCARBONATE ESTER AS A DEPOSIT-CONTROL ADDITIVE

BACKGROUND OF THE INVENTION

1. Field of the Invention

This invention relates to hydrocarbon fuels, containing additives which reduce the deposit tendency of hydrocarbon fuels. More specifically, this invention discloses motor fuels obtained by the addition of a minor amount of an alkenylsuccinyl (polycarbonate polyglycolethyleneoxy)-B-hydroxypropionate.

As automobile manufacturers increase the compression ratio of their automobile engines to obtain higher horsepower, the need becomes greater for gasolines which burn cleanly and have low deposit forming tendencies. Engine deposits which find their origin in the fuel are primarily responsible for surface ignition phenomena such as pre-ignition and octane requirement increase (ORI) which is the tendency of increasing octane requirement during the first several thousand miles of operation. Basically this octane requirement increase is caused by deposits building up in the engine's combustion chambers which can cause engine 'knock' or 'ping'. Formally, knock or ping was stopped by either de-tuning the car's engine or by changing to a higher octane gasoline. The combustion chamber deposits also can cause engine run-on which is the sputter and clatter that is heard sometimes after an engine has been turned off. The present invention seeks to reduce the building up of deposits in an engine's combustion chamber so as to reduce engine knock and run-on and avoid octane requirement increases requiring the switch to a premium grade of gasoline.

2. Patent Information Disclosure

The most relevant art is constituted by coassigned U.S. Pat. No. 2,844,448 which relates to hydrocarbon fuels containing polyglycol carbonate esters to reduce the deposit-forming tendencies of such fuels. These polyglycol carbonate esters have the general formula $$R'OOCO(RO)_nCOOR''$$

wherein R is a divalent aliphatic radical containing at least two carbon atoms, R' and R'' are aliphatic hydrocarbons containing between 3 and 18 carbon atoms and n is an integer having a value of at least two. While these compounds are denominated in the patent "polycarbonates", the synthesis by which they are obtained can only lead to bis-carbonates and indeed all the examples in the patent are of bis-carbonates. The efficacy of the polyglycol carbonate esters in controlling the deposit-forming tendencies of motor fuels was demonstrated in the patent by a Modified Chevrolet Deposits Test - CRCFL - 2-650. The engine cleanliness was determined by a modified Chevrolet S-II test. The octane requirement increase was determined in the patent by the Lauson H-2 ORI Test Procedure. These tests were in current use in the 1940s and in the early 1950s using engines which are far different in octane requirements from present day engines. While fuels containing the bis-carbonates of the patent passed the above three mentioned tests they do not pass tests designed for present-day engines.

SUMMARY OF THE INVENTION

The invention provides a normally liquid hydrocarbon fuel for internal combustion engines having a boiling point of about 300° to 700° F. and containing from about 50 to about 100 pounds per thousand barrels PTB of at least alkenylsuccinyl (polycarbonate-polyglycolethyleneoxy)-B-hydroxypropionate of the formula:

$$R-O(C{=}O-OCH_2-CH_2-O-CH_2CH_2-O)_xCH_2CH_2-O-\overset{\overset{\displaystyle O}{\|}}{C}-O(CH_2)_2OH$$

where R is an alkenylsuccinyl radical wherein the alkenyl moiety preferably is polyisobutenyl having a preferred molecular weight range of 235–3000 with the most preferred being 335 and x is an integer from 2 to 10 with the range of 5 to 8 being preferred.

Illustrative useful compounds encompassed by the above formula are tabulated below:

| Example | R(MW) | X |
|---|---|---|
| 1 | 335 | 5 |
| 2 | 235 | 2 |
| 3 | 500 | 3 |
| 4 | 600 | 4 |
| 5 | 700 | 5 |
| 6 | 1000 | 6 |
| 7 | 1500 | 7 |
| 8 | 2000 | 8 |
| 9 | 2500 | 9 |
| 10 | 3000 | 10 |

DISCLOSURE OF BEST MODE OF THE INVENTION

The present polycarbonates used as deposit control additives are known in the art, for example, from coassigned U.S. Pat. No. 4,267,120, incorporated herein by reference, which shows these prepared by the reaction of a cyclic organic acid anhydride, a 1,2-epoxide, carbon dioxide and a polyhydric compound in the presence of a basic catalyst.

The additives of the invention are generally soluble in gasoline or may be dissolved therein without forming a haze in a cosolvent if desired. The major application of the additives is in gasolines for automotive engines wherein fuel-derived engine deposits have become a particularly vexing problem. The deposit-forming properties of diesel fuels and fuels designed for use in jets and gas turbines are also improved by the polycarbonate esters of this invention. In diesel fuels, the presence of the ester maintains the injection system in the combustion zone in a clean condition. The additives also find application in jet fuels which are used as cooling mediums prior to their consumption. An ester-containing jet fuel is an excellent heat exchange medium since it is relatively free from deposits in the cooling system and burner nozzle where deposits can not be tolerated.

The deposit-forming properties of both regular and premium gasolines both of the leaded and un-leaded type are improved by the addition of the present additives. The gasolines to which the additives are added can be broadly defined as mixtures of hydrocarbons having a boiling point of 75° to 450° F.

In testing the efficiency of the subject additives for their intended use, there is used an engine called the Onan which generates piston top deposits which can be related to the known octane requirement increase characteristics of fuels and lubricants. This engine is used for deposit generation and is single cylinder L-Head design engine operated on a dynamometer equipped with test stand. It has provision for controlling cooling temperature to within ±2° F. and fuel flow or ±0.5 lb/hr. The crankcase lubricant used in the engine is a 10W-40 motor oil. The fuel under examination is tested in the Onan engine for 192 hours. At intervals of 24, 48, 72, 96, 120, 144, 168 and 192 hours, the piston top is removed and weighed to determine the amount of deposit build-up. This amount is then compared with the deposit weight produced by the same unleaded gasoline similarly run in the same engine.

The invention is further illustrated by the following examples:

EXAMPLE I

Alkenylsuccinyl (alkenyl MW of 335) (polycarbonatepolyglycolethyleneoxy)-B-hydroxypropionate (X=5) was blended at 50 PTB to 200 PTB in unleaded gasoline in the Onan Engine for 192 hours. At intervals of 24, 48, 72, 96, 120, 144, 168 and 192 hours, the piston top was removed and weighed. Then a comparison was made with the deposit weights of unleaded base fuel similarly run in the Onan Engine. It was found that the additive was effective in controlling deposit since, after 192 hours, the modified fuel had formed only 0.31 g of deposit but the neat fuel had formed 0.49 g.

The additive of Example I was evaluated and compared with other additives for performance as an ORI reducer by the RDH Test. This Test correlates well with results obtained with road simulation tests.

The test facility uses a closed air system with fuel introduced by a pneumatic atomizing spray nozzle. Before entering the module, the air is filtered and treated by (in order): a gel, oil vapor remover and Ultipore filter to ensure that the engine charge air contains minimum amounts of water, oil droplets and vapors. Engine air flow, measured by a sharp edged orifice, is heated in a surge tank and mixed with the fuel near the engine intake port. Fuel flow is measured with a Cox Instruments flow meter. The fuel and air systems provide close control of the intake charge to the engine under cycling conditions and during octane rating of the engine. An engine's octane requirements directly reflect the condition to which the end gases are subjected. ORI with a fuel and/or lubricant, reflects the amount and type of combustion chamber deposits which the fuel and/or lubricant cause. If the rating conditions such as mixture temperature, intake charge rate, coolant temperature, engine speed, etc. which affect the state of end gases are kept constant from one rating to the other, any change in the state of the end gases will be in consequence to change in combustion chamber deposits. Subsequently, the octane requirement of the engine will increase as the deposits accumulate and eventually the octane requirement will stabilize with the stabilization of combustion chamber deposits. The tests results are reported after the ORI is stabilized which requires varying amounts of time depending on the fuel tested. The ORI reported is the difference between the final and initial values with a lower absolute value signifying improved performance. As shown in Table I below, the additive of the invention outperforms the comparison additives and the neat fuel.

TABLE I

| RDH TEST | ORI | HOURS* |
|---|---|---|
| B.F. + 100 PTB of polypropylene (MW800) | 10, 8 | 182, 124 |
| B.F. + 100 PTB L-14 ASAA polycarbonate (Invention) | 5, 6 | 204, 125 |
| B.F. Full boiling range fuel | 7, 6, 5 | 160, 180, 119 |
| B.F. + 0.2% of B | 8, 8.5 | 199, 121 |
| B.F. + 1035 PTB of C | 8 | 212 |

BF = Base fuel
B = Commercial additive package containing polypropylene (MW800) solvent neutral oil oxidate and N,N'-di15($C_{14}$–$C_{20}$ sec alkyl) aspartamide in "Petrox" carrier oil.
C = Commercial detergent consisting of polybutenyl amine (probably EDA).
*Hours at which ORI was stabilized.

EXAMPLE II

Dodecenylsuccinyl (polycarbonate-polyglycolethyleneoxy)-B-hydroxypropionate was used at 100 PTB in unleaded gasoline and tested by the Combustion Chamber Deposits Screening Test (CCDST). In this Test, a test gasoline is atomized with a nitrogen/air mixture and sprayed onto a heated aluminum deposit tube. The amount of deposits formed on the tube after 100 minutes is then determined and reported in milligrams. Gasolines which give the greatest ORI form the greatest amount of deposits. The compound of Example II was tested with the results given below.

| CCDST | | | |
|---|---|---|---|
| Experimental Additive | Ept'l mg | Low Ref. Base fuel | High Ref. TYA-462 |
| 100 PTB Dodecenylsuccinic-polycarbonate* | 5.7 | 3.3 | 5.3 |

The data indicate that dodecenylsuccinic acid ester of polycarbonate is not an effective ORI controller.
*Fuel was hazy rendering additive not usable.

These data of the above examples establish the fact that the present additives are able to control the amount of combustion chamber deposits caused by the burning of gasoline. The data also establish that the presence of the alkenylsuccinyl radical is critical to the performance of the additives.

Naturally included within the scope of the invention are gasolines containing the usual amount of conventional additives present in an amount necessary to fulfill their functions therein. Accordingly, anti-knock additives, dyes, corrosion inhibitors, anti-oxidants and the like can be beneficially employed in the fuels of the invention without materially affecting the novel additive of the invention. The present invention constitutes the discovery of a previously unknown and unexpected property possessed by certain propionates.

It will be evident that the terms and expressions employed herein are used as terms of description and not of limitation. There is no intention, in the use of these descriptive terms and expressions, of excluding equivalents of the features described and it is recognized that various modifications are possible within the scope of the invention claimed.

We claim:

1. A normally liquid hydrocarbon fuel for internal combustion engines having a boiling point of 75°–700° F. and containing of at least one alkenylsuccinyl (polycarbonatepolyglycolethyleneoxy)-B-hydroxypropionate of the general formula:

$$R-O-(COOCH_2CH_2OCH_2CH_2O)_xCH_2CH_2O\overset{\overset{\displaystyle O}{\|}}{C}O(CH_2)_2OH$$

wherein R is alkenylsuccinyl in which the alkenyl radical has a molecular weight in the range of about 250 to 3000 and x is an integer ranging from 2 to 10.

2. The fuel of claim 1, wherein x ranges from about 5 to about 8.

3. The fuel of claim 1 containing from about 50 to about 100 PTB of said ester.

4. The fuel of claim 1 wherein said alkenyl radical has a molecular weight in the range of 235 to 3000.

5. The fuel of claim 4 wherein said alkenyl radical has a molecular weight of about 335.

6. The fuel of claim 1 consisting of a mixture of hydrocarbons having a boiling point of 75° to 450° F.

7. The method of operating an internal combustion engine which comprises providing thereto and combusting therein a fuel as defined in claim 1.

* * * * *